FIG. 1
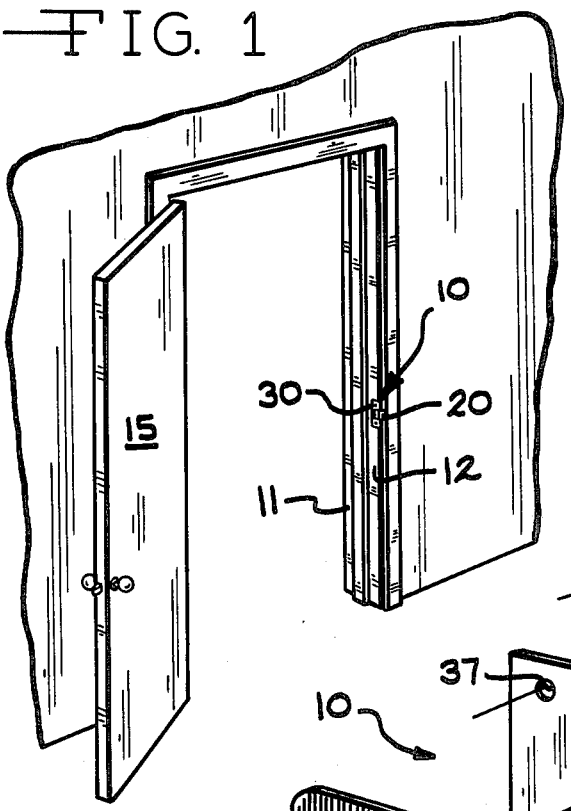
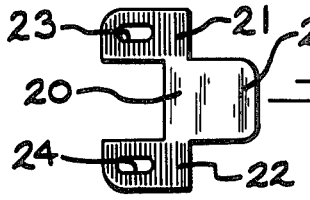
FIG. 2
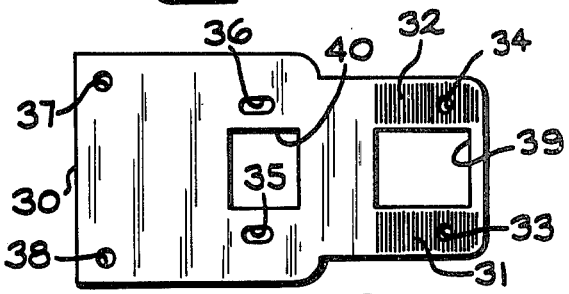
FIG. 3
FIG. 4
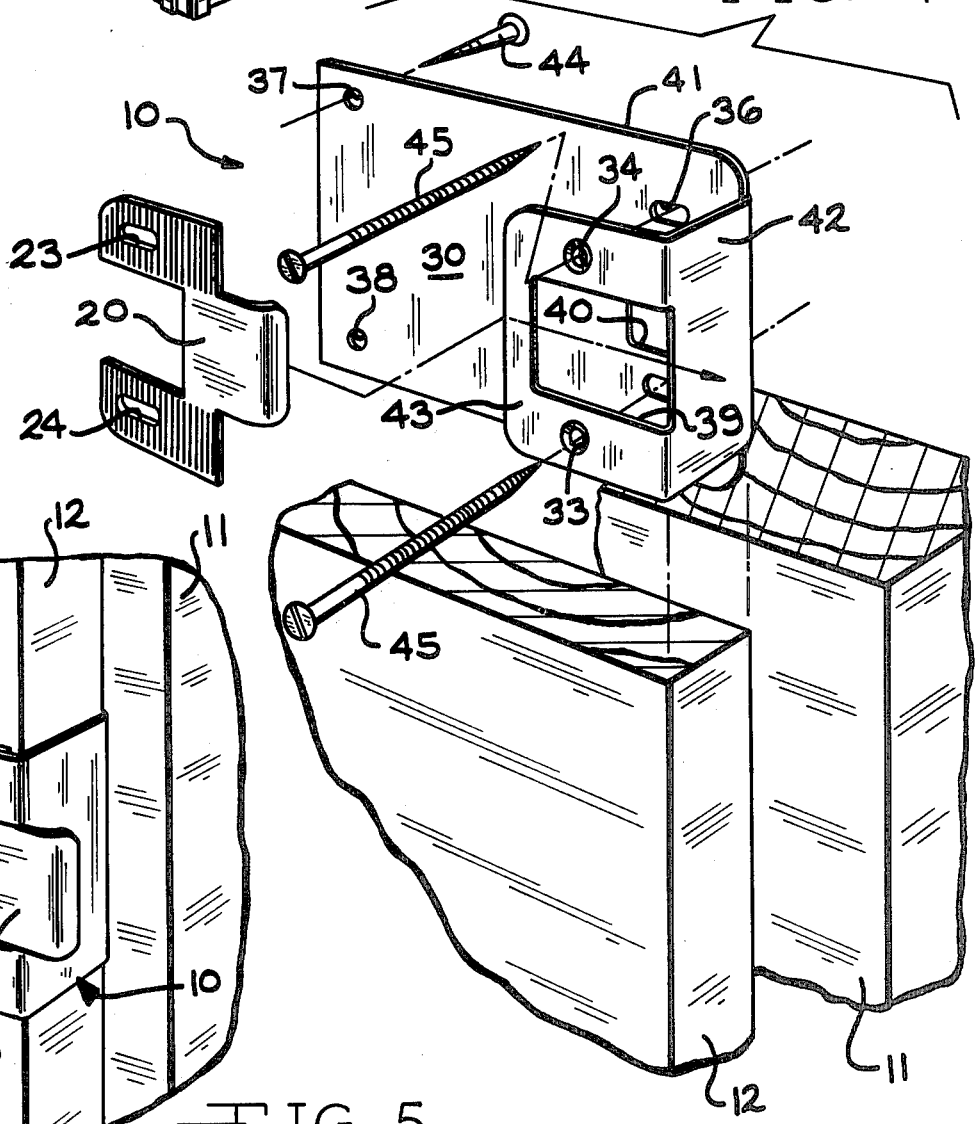
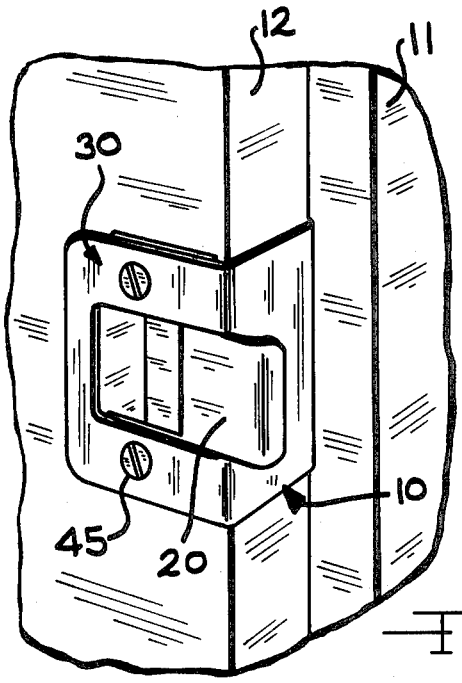
FIG. 5

United States Patent [19]

St. Aubin

[11] 4,171,836

[45] Oct. 23, 1979

[54] SECURITY STRIKE PLATE ASSEMBLY

[75] Inventor: William R. St. Aubin, Perrysburg, Ohio

[73] Assignee: LST Corporation, Toledo, Ohio

[21] Appl. No.: 904,609

[22] Filed: May 10, 1978

[51] Int. Cl.[2] ..... E05C 19/00

[52] U.S. Cl. ..... 292/341.18; 292/DIG. 55

[58] Field of Search ..... 292/341.18, 341.19, 292/341.14, 341.11, 341, 340, 346, DIG. 55

[56] References Cited

U.S. PATENT DOCUMENTS

| | | | |
|---|---|---|---|
| 1,010,365 | 11/1911 | Hensle | 292/340 X |
| 2,695,807 | 11/1954 | Bissot | 292/341.18 |
| 2,695,808 | 11/1954 | Manchester | 292/341.18 |
| 3,888,530 | 6/1975 | Fabrici | 292/346 X |

FOREIGN PATENT DOCUMENTS

| | | | |
|---|---|---|---|
| 821429 | 8/1969 | Canada | 292/341.18 |
| 133860 | 2/1933 | Fed. Rep. of Germany | 292/340 |
| 17808 | of 1910 | United Kingdom | 292/346 |

*Primary Examiner*—J. Franklin Foss

*Attorney, Agent, or Firm*—Richard D. Emch

[57] ABSTRACT

An improved security strike plate assembly is provided. The assembly consists of a wrap-around security plate which normally includes an adjustable strike plate. The security plate extends around three sides of a wood lock-side jamb member to which it is mounted in order to enhance the impenetrability of the door by preventing splitting of the lock-side jamb and resultant dislocation of the strike plate and keeper during thrusts against the door. The strike plate is adjustable without removing the security plate to accommodate slight variations in the size or shape of the door or frame during seasonal or atmospheric changes.

4 Claims, 5 Drawing Figures

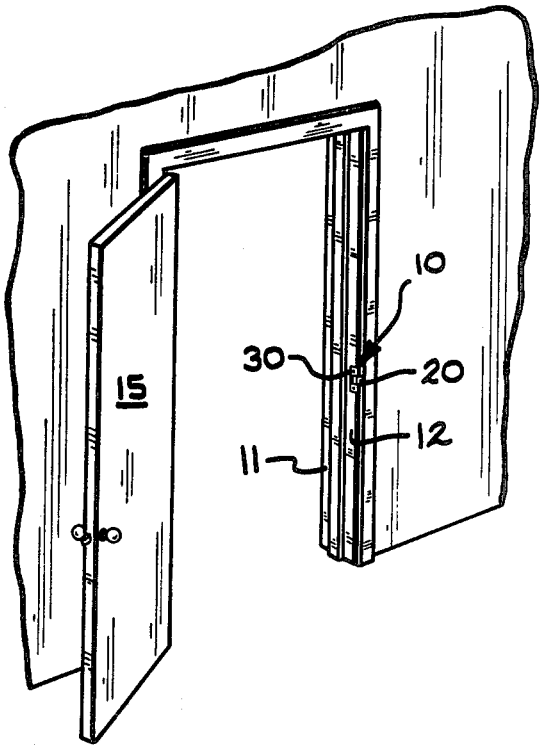

SECURITY STRIKE PLATE ASSEMBLY

BACKGROUND OF THE INVENTION

This device relates to the field of closures for buildings typically having hinged doors which require an entry-proof locking arrangement.

Many devices are available to frustrate the practice of inserting a thin flexible tool between the door and jamb member to slide the bolt back into the door, allowing the door to swing open. These burglar-proofing guards, once discovered by the wrongful entrant, often lead to more forcible entry of the door.

Persons without keys wanting to make unauthorized entry into locked buildings have been able to do so by thrusting themselves or other weighted objects against the door. This splits the wood jamb dislocating the retention of the lock bolt which normally passes from the door into the strike plate keeper, thereby allowing the door to be opened and entry to be gained.

In a typical installation of the door, the door is hinged at two or three locations on one vertical side of a door frame, and is kept closed or locked at the other vertical side of the door frame at only one location. At the single door-locking location there is a retractable lock bolt which normally extends from the edge surface of the door. The bolt can be pivotally or slidably mounted inside the door in a spring-loaded manner allowing it to deflect to one side, or retreat into the door, upon one's closing the door. During closing the bolt passes the strike plate until it is received in strike plate opening. The bolt can then be locked in a non-retractable position by a key or other locking means. Because the bolt is usually the strongest element of a lock, when in its extended position the bolt itself resists thrust forces against the door. What usually occurs during thrusts against the door is that the wooden jamb splits or fails, allowing entry.

The purpose of this invention is to provide a substantially stronger and more entry-proof locking area of a hinged door by reinforcing the lock bolt receiving area, while making ajustable the space between the lock bolt and its keeper edge in the stroke plate.

According to the present invention, a security strike plate assembly is mounted to the jamb of a door either before or after the installation of the jamb piece into the door opening. When mounted to the jamb piece before its installation in the door opening, some of the mounting screws therefor will become inaccessible, thereby rendering the security plate practically permanently affixed to the jamb piece, once the jamb piece is installed into the door frame.

BRIEF DESCRIPTION OF THE DRAWINGS

FIG. 1 is a perspective view of a typical door and frame to which a security strike plate assembly is normally mounted according to the present invention;

FIG. 2 is a plan view of an adjustable strike plate member of a security strike plate assembly according to the invention;

FIG. 3 is a layout view of the security plate member of the assembly, showing said member before it is formed into its final "U" configuration;

FIG. 4 is an exploded perspective view of the component parts of the security strike plate assembly, mounting screws, a jamb member to which the security plate is mounted, and a framing stud of a door frame to which said jamb member attaches; and FIG. 5 shows the security strike plate assembly in position on a door jamb.

DESCRIPTION OF THE PREFERRED EMBODIMENT

A security strike plate assembly according to the present invention is generally indicated by reference number 10. The security strike plate assembly 10 includes an adjustable strike plate 20 and a security plate 30. The assembly or wooden jamb member 10 is mounted on a wooden door frame 11 which includes a separate jamb piece or jamb member 12. A door 15 constructed of wood, but preferably metal is mounted in the frame 11.

The security plate 30 includes an elongated planar section 41, a middle planar section 42, and a third planar section 43, which sections form a "U" configuration. The elongated planar section 41 and the third planar section 43 are in parallel relationship to each other, being connected together by the middle planar section 42 which is at right angles to such elongated section 41 and such third section 43. In the preferred embodiment, the security plate 30 is stamped from a sheet metal material. During the stamping operations, serrations 31, 32 are formed, and material is removed from the sheet metal plate to create the openings 39, 40, holes 33, 34, 37, 38, and slots 35, 36. The newly stamped security plate 30 is formed into its "U" configuration by subsequent bending operations.

In such "U" configuration, the primary lock bolt opening 39 is aligned with the secondary lock bolt opening 40, the mounting holes 33, 34 and axially aligned with the slots 35, 36, and the serrations 31, 32 are on the underneath surface of the third planar section 43.

The strike plate 20 is preferably stamped from a sheet material, during which stamping the serrations 21, 22 are made on the top surface of its leg portions, and material is removed to create the mounting slots 23, 24. The lip 25 of the strike plate 20 is formed by slightly bending the single-ended portion of the strike plate 20 in the direction of its bottom surface, as shown in FIG. 4.

In attaching the assembly 10 to a separate wooden jamb member 12, the strike plate 20 is placed with its serrations 21, 22 facing upward to mate with the serrations 31, 32 of the underneath surface of the third section 43 of the security plate 30. In such juxtaposition, the lip 25 of the strike plate 20 will be slid through the primary lock bolt opening 39 of the security plate 30, and its slots 23, 24 will be aligned with the holes 33, 34 of the third section 43 of the security plate 30.

The security strike plate assembly 10 is placed along the edge of a jamb piece 12 so that the underneath surface of the middle section 42 of the security plate 30 is resting flatly against the outside edge surface of the jamb piece 12, as shown in FIG. 5. Screws 44 are passed through the holes 37, 38 into the back of a jamb member 12. The jamb piece 12 is then attached to the door frame 11, which in the present embodiment comprises a framing stud, and the screws 45 are passed through the holes 33, 34 in the third section 43 of the security plate 30, through the jamb piece 12, through the slots 35, 36 in the elongated section 41 of the security plate 30 and finally into the door frame member 11. The screws 45 are not tightened thoroughly until the adjustable strike plate 20 is positioned to create the desired snugness of fit between the lock bolt and the strike plate 20 when the door is hinged and closed.

Because the door or door frame 11 may become slightly distorted during seasonal or atmospheric changes, the snugness of fit will become altered. It is then desirable to slightly loosen the screws 45, adjust the position of the strike plate 30 until a preferable snugness of fit is achieved, and retighten the screws 45, thereby keeping the strike plate 20 in its relocated position. This kind of adjustment can be made without removing or altering the location of the relatively permanently affixed security plate 30.

What I claim is:

1. A security strike plate assembly for use on a wooden door jamb to engage a bolt of a door lock, the door jamb including a lock-side jamb member, said security strike plate assembly comprising, a generally U-formed security plate having an elongated section including a first plurality of openings, a middle section perpendicularly extending from said elongated section to locate said plate along an edge of such jamb piece, and a third section parallel with said elongated section, said third section including a primary opening for receiving a lock bolt, said third section defining a second plurality of openings therethrough aligned with such first plurality of openings in said elongated section, whereby fastening members may be inserted through such aligned first and second pluralities of openings, into such door jamb said U-formed security plate including a lock bolt opening through said elongated section, said lock bolt opening being aligned with said primary opening.

2. A security strike plate assembly as described in claim 1, including a separate adjustable strike plate member adjacent said third section, said member defining an opening to receive the lock bolt, said member including a pair of legs and a lip adjacent said opening, said legs having slots aligned with said first and second pluralities of openings for receiving elongated fastening means to adjustably mount said lip to said third section.

3. A security strike plate assembly as described in claim 1, wherein said elongated section defines a third plurality of openings for initially mounting said security plate to such jamb piece by the use of fasteners passing into the back side of such jamb piece.

4. A security strike plate assembly as described in claim 2, including a plurality of serrations on said third section and a plurality of mating serrations on said legs.

* * * * *